US006923140B1

(12) United States Patent
Cook

(10) Patent No.: US 6,923,140 B1
(45) Date of Patent: Aug. 2, 2005

(54) BOAT ACCESS STAIRWAY

(75) Inventor: Anthony Jay Cook, Florence, SC (US)

(73) Assignee: Aluminum Ladder Company, Florence, SC (US)

( * ) Notice: Subject to any disclaimer, the term of this patent is extended or adjusted under 35 U.S.C. 154(b) by 0 days.

(21) Appl. No.: 10/792,016

(22) Filed: Mar. 3, 2004

(51) Int. Cl.[7] ..... B63B 17/00

(52) U.S. Cl. ..... 114/362; 14/71.1; 14/71.7

(58) Field of Search ..... 114/362; 182/2.7; 14/69.5, 71.1, 71.3, 71.5, 71.7

(56) References Cited

U.S. PATENT DOCUMENTS

| | | | | |
|---|---|---|---|---|
| 4,162,551 A | | 7/1979 | Serrano | 14/69.5 |
| 4,333,196 A | * | 6/1982 | Bougaran | 14/71.7 |
| 4,581,784 A | | 4/1986 | Rousseau et al. | 14/71.1 |
| 4,590,634 A | | 5/1986 | Williams | 14/71.1 |
| 4,971,168 A | | 11/1990 | Stanescu | 182/1 |
| 6,502,267 B2 | | 1/2003 | MacDonald et al. | 14/69.5 |

* cited by examiner

*Primary Examiner*—Sherman Basinger
(74) *Attorney, Agent, or Firm*—Charles L. Schwab; Nexsen Pruet, LLC

(57) ABSTRACT

A boat access stairway having a landing attachable to a pier, a ramp which can be raised, lowered and slewed and a platform at the free end of the ramp whose orientation relative to a boat positioned parallel to the pier remains the same regardless of the slewed condition of the ramp.

12 Claims, 6 Drawing Sheets

BOAT ACCESS STAIRWAY

BACKGROUND OF THE INVENTION

In order to load and unload manifest items from a boat it is customary to provide a gangplank for passengers and small cargo items. Changing water levels give rise to the need to provide adjustable loading and unloading ramps. Ramps are not only necessary for ocean going boats but are also needed for loading and unloading manifest items of barges. Changes in river water levels present problems similar to changing tides. Although a flat ramp may be satisfactory for loading and unloading operations if the slope of the ramp is not steep, the changing tides and river levels give rise to a need for a safer conveyance surface with steps being generally preferred. In providing a pier mounted access ramp to a barge there is a need to maintain the same orientation of the barge boarding platform regardless of the slewed condition of the ramp. In other words it is desirable for the exit from the barge boarding platform to face the same direction relative to the barge regardless of the slewed position of the ramp.

BRIEF SUMMARY OF THE INVENTION

The boat access stairway of this invention provides a versatile conveyance for transferring the manifest items to and from a boat such as a barge. A landing is provided for attachment to a pier which includes a first part fixed to the pier and a second part pivoted to the first part on a vertical axis. A ramp is pivotally connected to the second part of the landing on a horizontal pivot axis. These two pivot connections permit raising and lowering of the ramp and slewing of the ramp. The boat access stairway includes power apparatus for slewing the ramp and for raising and lowering the ramp. Additionally, the boat access stairway includes a platform at the free end of the ramp which can be set down on a boat. The platform has a first segment pivotally connected to the outer end of the ramp on a horizontal axis and a second segment pivotally connected to the first segment on a vertical axis. The second segment includes a floor. Two laterally spaced upright spars are pivotally supported on the stationary part of the landing on vertical axes and two laterally spaced upright spars are pivotally supported on the second segment of the platform. Upper and lower links are pivotally connected at their corresponding opposite ends to the spars on the landing and the platform and when the ramp is slewed the platform retains the same general orientation relative to the boat. The access stairway may be slewed to compensate for the distance between the pier and the boat, but in doing so the exit from the platform onto the boat maintains it direction orientation.

BRIEF DESCRIPTION OF THE DRAWINGS

One embodiment of the invention is shown in the drawings, in which.

DETAILED DESCRIPTION OF THE INVENTION

Figure 1A:
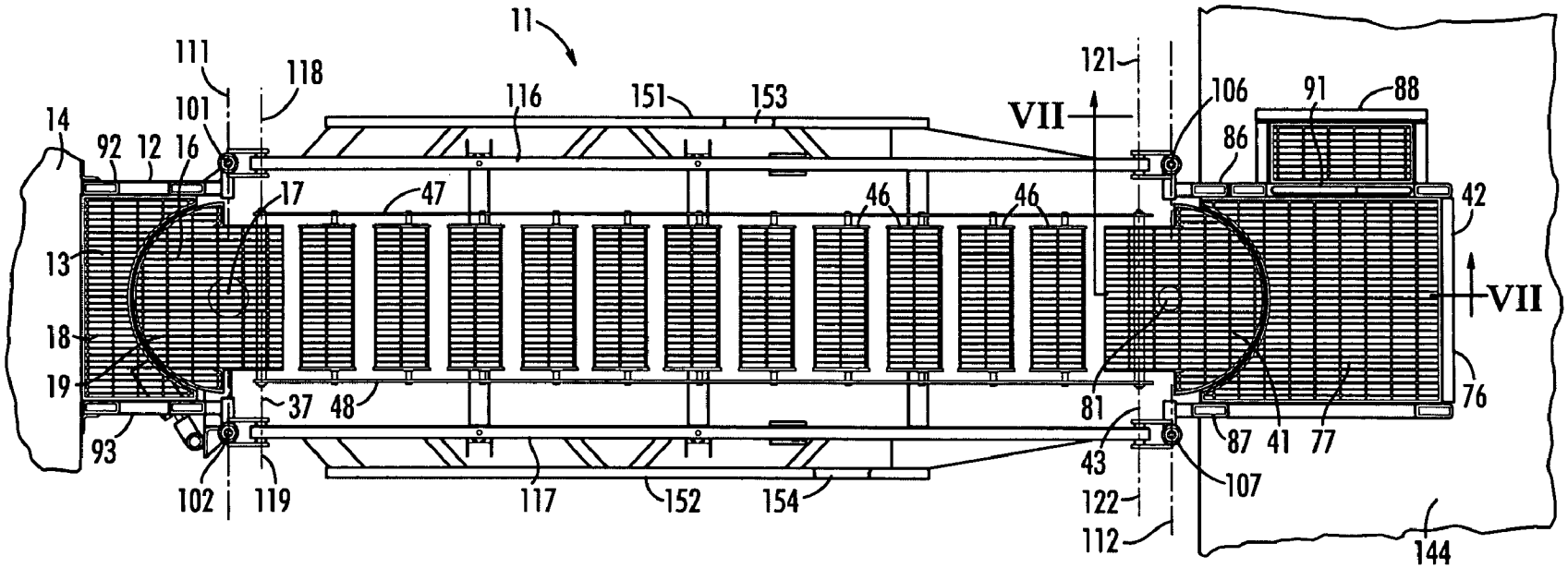
FIG. 1A is a top view of the boat access stairway with certain parts removed for illustration purposes.

The conveyance illustrated in the drawings is a boat access stairway 11 designed for attachment to a pier 14. FIG. 1A is a top view of the boat access stairway 11 having a landing 12 which has a first part 13 rigidly secured to the pier 14. The landing 12 also includes a second part 16 pivotally connected to the first part on a vertical pivot axis 17. The stationary first part 13 and the pivotable second part 16 of the landing 12 have floors 18, 19 on the same level with confronting complimentary semi-circular edges.

Figure 5:
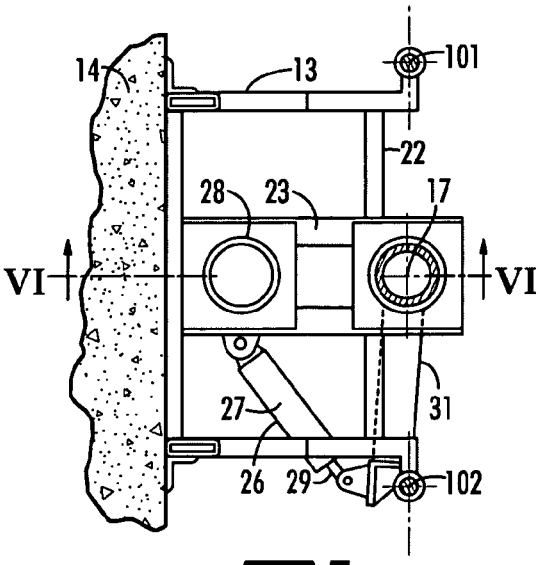
FIG. 5 is a section taken on the line V—V in FIG. 3.
Figure 6:
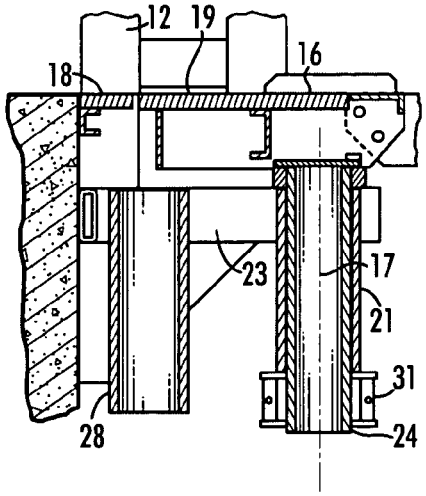
FIG. 6 is a section taken on the line VI—VI in FIG. 5.

Referring also to FIGS. 5 and 6, the first part 13 of the landing 12 includes a sleeve bearing 21 supported by struts 22, 23 and the second part 16 of the landing includes a vertical pivot tube 24 pivotally supported in the sleeve bearing 21 for pivotal movement about the vertical axis 17. Pivotal movement of the second part 16 of landing relative to its first part 13 is effected by extension and contraction of a linear fluid power actuator 26 having of a cylinder 27 pivotally connected to a cylindrical support member 28 on the first part 13 and a piston having a rod 29 pivotally connected to a lever arm 31 nonrotatably fastened to the pivot tube 24.

Figure 1B:
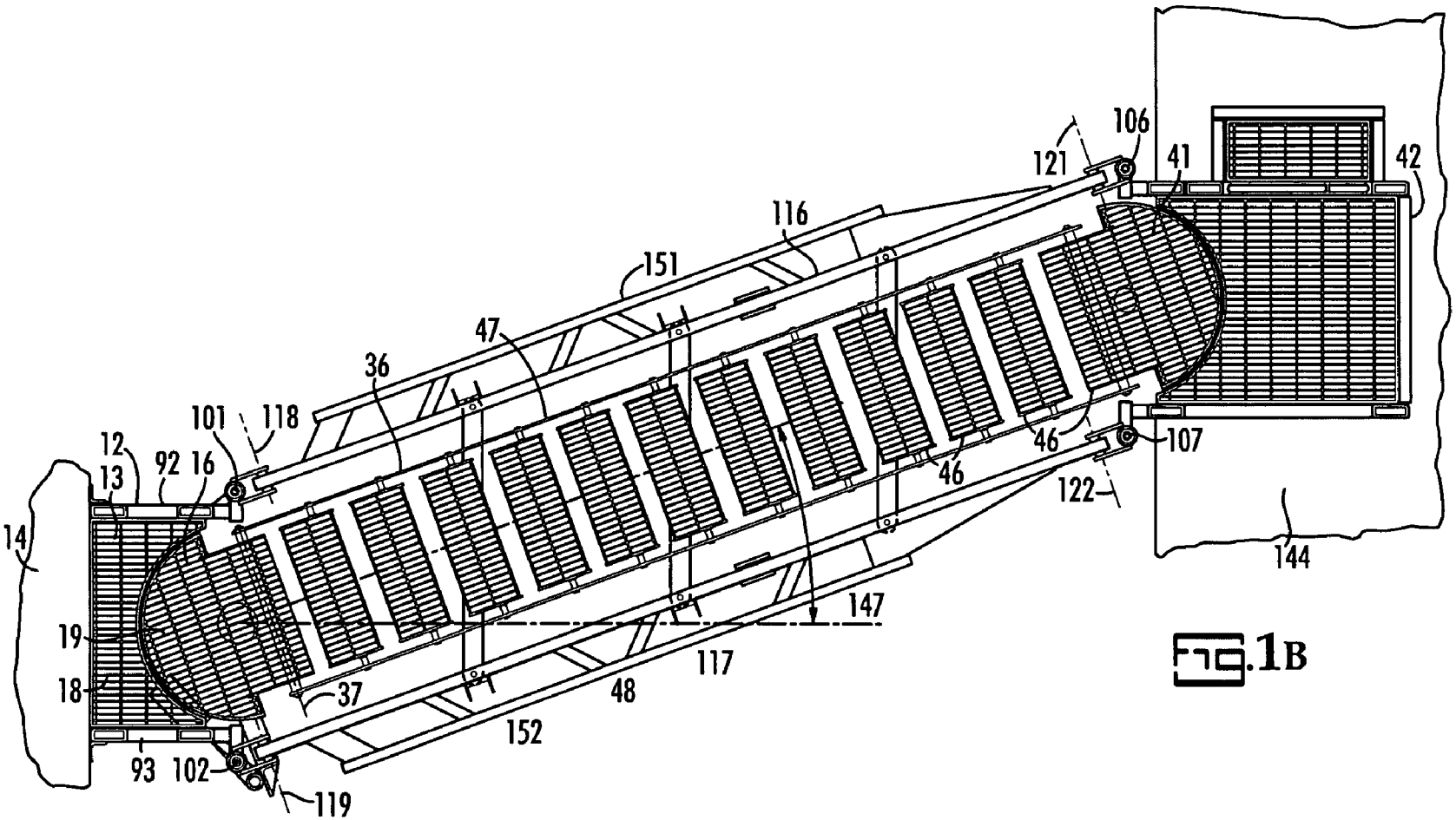
FIG. 1B is a top view of the boat access stairway similar to FIG. 1 but with the stairway slewed.

As shown in FIGS. 1A and 1B the boat access stairway 11 includes an elongated ramp 36 having one of its longitudinal ends pivotally connected to the second part 16 of the landing 12 on a horizontal pivot axis 37 which is transverse to the direction of elongation of the ramp 36. The other longitudinal end of the ramp 36 is pivotally connected to a first segment 41 of a platform 42 on a second horizontal pivot axis 43 which is parallel to the axis 37. The ramp 36 is a stairway with self leveling steps 46 pivotally supported on and between a pair of parallel stringers 47, 48. Corresponding ends of the stringers 47, 48 are pivotally connected on the axis 37 to the second part 16 of the landing 12 and on the axis 43 to the first segment 41 of the platform 42.

Figure 2:
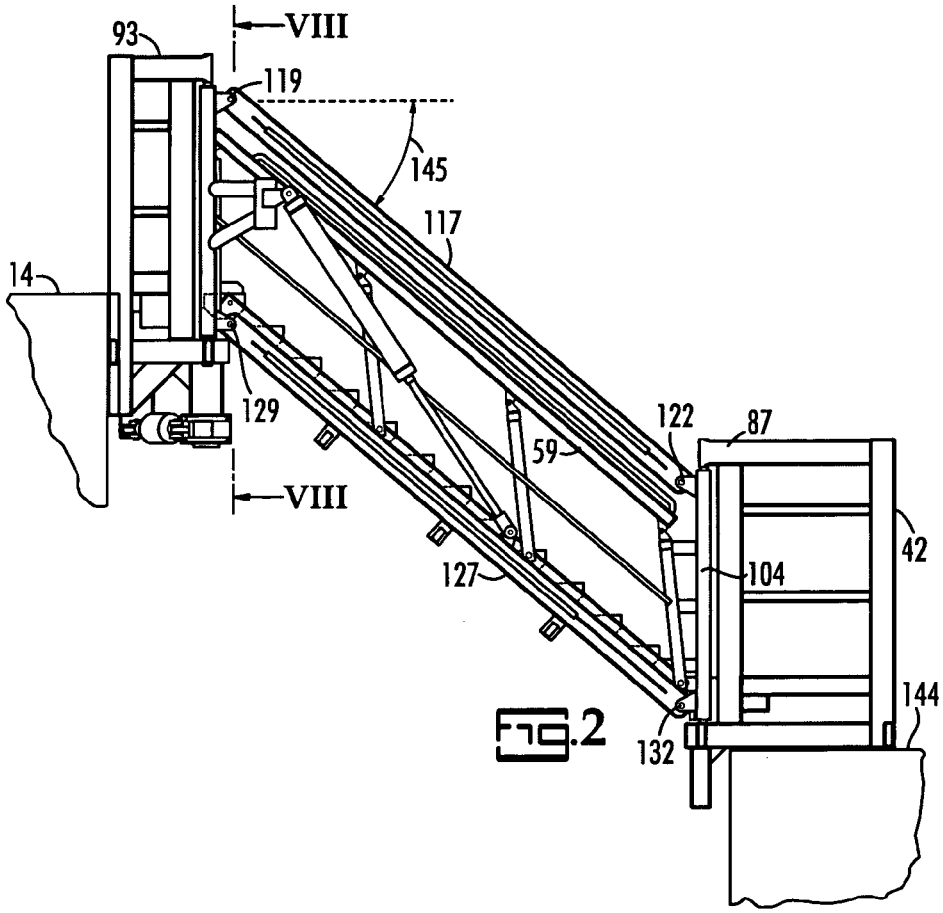
FIG. 2 is a side view of the boat access stairway adjusted for access to a boat deck substantially lower than the pier.
Figure 3:
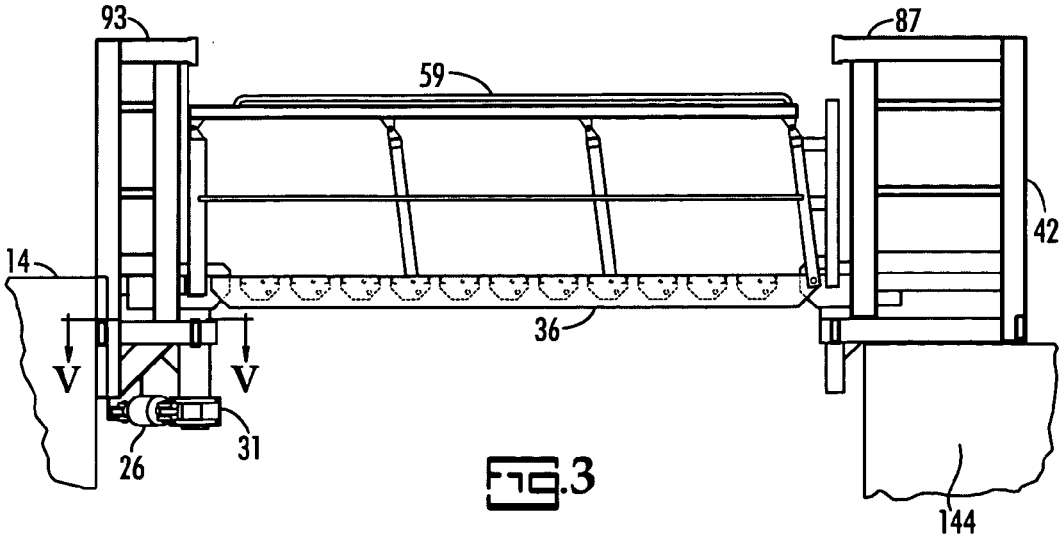
FIG. 3 is a side view of the boat access stairway with parts removed for illustration purposes and showing its boat access position when the boat deck is about the same elevation as the pier.
Figure 7:
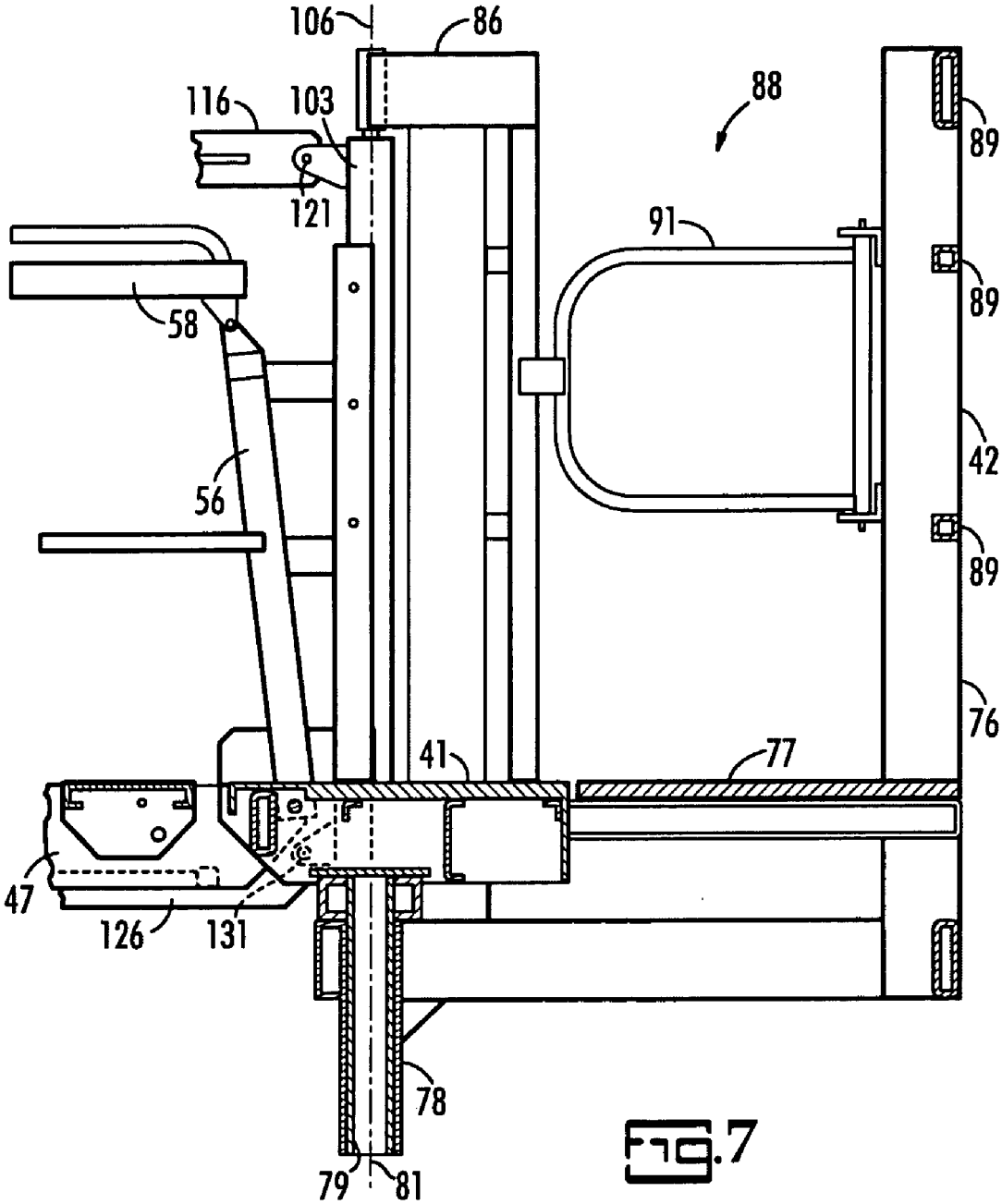
FIG. 7 is a section taken on the line VII—VII in FIG. 1A.
Figure 8:
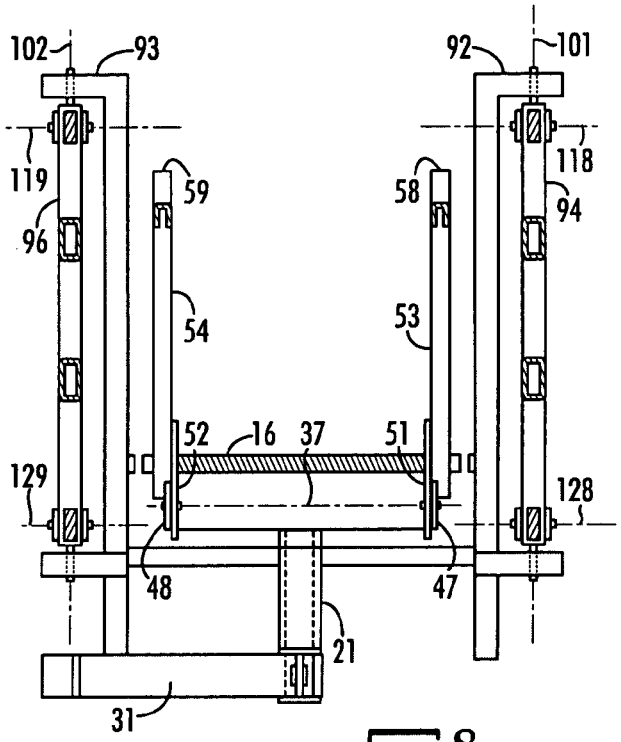
FIG. 8 is a section taken on the line VIII—VIII in FIG. 2.
Figure 9:
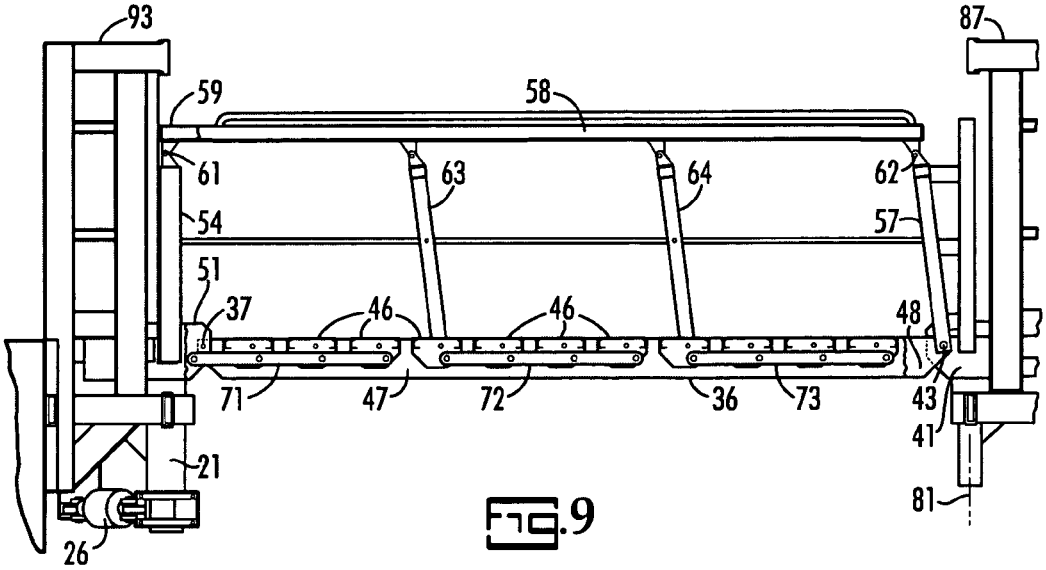
FIG. 9 is a side view of the boat access stairway with parts removed for illustration purposes.

As shown in FIGS. 3, 8 and 9, the second part 16 of the landing 12 includes a pair of laterally spaced vertically extending support plates 51, 52 to which the stair stringers 47, 48 are pivotally connected, respectively. A pair of laterally spaced vertical stand posts 53, 54 are rigidly secured at their lower ends to the second part 16 of the landing 12. As shown in FIGS. 2, 3, 4, 7 and 9 a pair of laterally spaced vertically extending rigid posts 56,57 are rigidly secured to the first segment 41 of the platform 42. A pair of laterally spaced parallel rails 58, 59 have corresponding opposite ends pivotally connected to the upper ends of stand posts 53, 54 and the rigid posts 56, 57 on parallel horizontal axes 61, 62. Axes 37, 43, 61, 62 define corners of a parallelogram. Intermediate vertical posts 63, 64 are rigidly connected at their lower ends to a longitudinally spaced pair of steps 46 and are pivotally connected at their upper ends to the rail 58. Intermediate vertical posts 66, 67 are rigidly connected at their lower ends to the same longitudinally spaced pair of steps 46 and are pivotally connected at their upper ends to the rail 59. As shown in FIG. 9, stair leveling links 71, 72, 73 serve to pivot the steps 46 to maintain their treads horizontal when the ramp 36 is pivoted up or down relative to the pier 14.

The platform 42 includes a second segment 76 pivotally connected to the first segment 41 on a vertical pivot axis 81. As shown in FIG. 7 the second segment 76 includes a floor 77 and a pivot sleeve 78 pivotally supporting a tube component 79 of the first segment 41 inserted in and in cylindrical surface bearing relation with the interior of the sleeve 78. Thus the first and second segments 41, 76 of the platform 42 are connected for relative pivotal movement about the vertical pivot axis 81. The second segment 76 includes a pair of laterally spaced upstanding structures 86, 87 and a safety railing 89 around the floor 77 except for the arc cut out portion of the floor mating with a semi circular part of the floor 41 and except for a gateway 88. An inward opening gate 91 is provided at the gateway 88.

Referring to FIG. 8, the landing 12 includes a pair of laterally spaced vertical walls 92, 93 to which the upper and lower ends of a pair of laterally spaced parallel vertical spars 94, 96 are pivotally connected on parallel vertical axes 101, 102. In a similar manner a pair of laterally spaced parallel vertical spars 103, 104 are pivotally connected at their upper and lower ends to the upstanding structures 86, 87 of the second segment 76 of the platform 42 for pivotal movement about a pair of vertical axes 106, 107. As shown in FIG. 1A the vertical axes 101, 102 and 17 lie in a common vertical plane 111 and the axes 106, 107, 81 lie in a common vertical plane 112. The pivot axes 101, 102, 106, 107 define the corners of a parallelogram. Axes 101 and 102 are equal distances from axis 17 and axes 106, 107 are equal distances from axis 81. This configuration permits slewing of the stairway 36 as illustrated in FIG. 1B.

A parallel lift linkage arrangement is provided for raising and lowering the gateway 42 and for maintaining the orientation of the platform 42 when the stairway 36 is slewed. The lift linkage includes a pair of laterally spaced parallel upper links 116, 117 having first corresponding ends pivotally connected to the upper ends of the first pair of upright spars 94, 96 on parallel horizontal axes 118, 119, respectively, and having second corresponding ends pivotally connected to the upper ends of the second upright spars 103, 104 on parallel horizontal axes 121, 122, respectively. The lift linkage also includes a pair of laterally spaced parallel lower links 126, 127 having first corresponding ends pivotally connected to the lower ends of the first upright spars 94, 96 on horizontal axes 128, 129, respectively, and second corresponding ends pivotally connected on parallel horizontal axes 131, 132 to the lower ends of the second pair of upright spars 103, 104, respectively. The axes 118, 121, 128, 131 define the corners of a parallelogram and the axes 119, 122, 129, 132 define the corners of a parallelogram. The links 116, 117, 126, 127 include braces 151, 152, 153, 154 along their laterally outer sides.

The stairway 36 and platform 42 are raised and lowered by a pair of linear actuators in the form of fluid rams 136, 137 interconnected between the first pair of upright spars 94, 94 and the lower links 126, 127.

Figure 4:
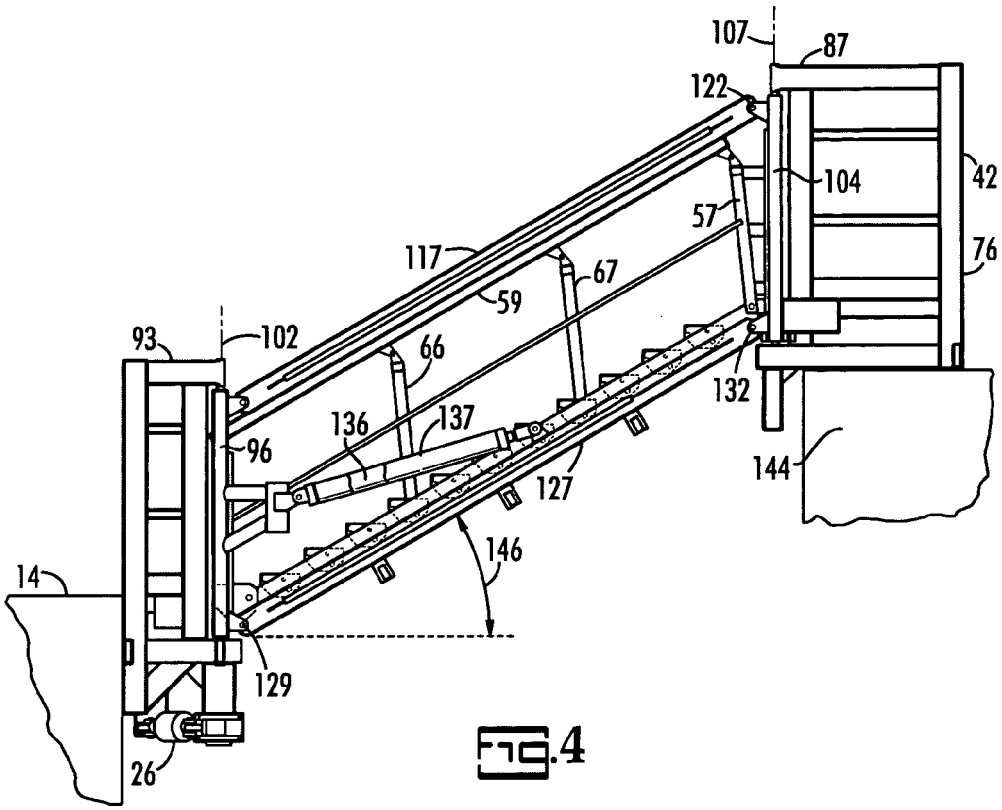
FIG. 4 shows the boat access stairway in a raised position.

The herein described and illustrated boat access stairway can be secured to a pier to afford access to a boat or barge 144 adjacent the pier. FIG. 2 shows the stairway 36 sloping downward at a 40 degree angle 145 and FIG. 4 shows the stairway sloping upward at an angle 146 of 30 degrees. The desired elevation of the platform 42 will depend on the water level and the elevation of the barge deck on which the platform 42 is set down. The pivoting of the upright spars 94, 96, 103, 104 on vertical axes and the pivot connections between parts and segments of the landing and platform, respectively, permits the stairway to be slewed in either direction. As shown in FIG. 1B the stairway 36 is slewed by an angle 147 of 20 degrees. It is desirable that the gateway 88 of the platform 42 face the same direction regardless of the slewed position of the stairway. This orientation maintenance is provided by the parallel raising links 116, 117, 126 and 127 interconnected between the landing 12 and the platform 42.

What is claimed is:

1. A conveyance attachable to a pier for facilitating loading and unloading the manifest items of a boat, comprising:

a landing including a first part adapted for rigid connection to said pier and including a floor, a second part pivotally connected to said first part on a first vertical pivot axis including a floor and a first power means interconnected between said first and second parts operable to pivot said second part relative to said first part about said first vertical axis, an elongated ramp having one of its longitudinal opposite ends pivotally connected to said second part of said landing on a first horizontal pivot axis transverse to the direction of elongation of said ramp, a barge boarding platform having a first segment pivotally connected to the other longitudinally opposite end of said ramp on a horizontal pivot axis parallel to said first horizontal pivot axis and including a floor, and a second segment pivotally connected to said first segment on a second vertical axis and including a floor, a lift linkage including a pair of laterally spaced parallel upper links having first correspondence ends pivotally connected, respectively, to said first part of said landing for horizontal swinging movement about a first pair of vertical axes and for vertical swinging about horizontal axes lying in a horizontal plane and having second corresponding ends pivotally connected, respectively, to said second segment of said platform for horizontal swinging movement about a second pair of vertical axes and for vertical swinging movement about horizontal axes lying in a horizontal plane, a pair of laterally spaced parallel lower links having first corresponding ends pivotally connected, respectively, to said first part of said landing for horizontal swinging movement about said first pair of vertical axes and for vertical swinging movement about horizontal pivot axes lying in a horizontal plane and having second corresponding ends pivotally connected, respectively, to said second segment for horizontal swinging movement about said second pair of vertical axes and for vertical swinging movement about horizontal axes lying in a horizontal plane, and second power means operatively associated with said lift linkage operable to raise and lower said platform to and from a boat disposed adjacent said pier, said upper and lower links maintaining said platform in the same orientation relative to said pier regardless of the pivot position of said second part of said landing relative to said first part of said landing.

2. The conveyance of claim 1 wherein said ramp is a stairway with self leveling steps.

3. The conveyance of claim 1 wherein said links are spaced laterally outward from said ramp.

4. The conveyance of claim 3 wherein each of said links includes braces on their laterally outer sides.

5. The conveyance of claim 1 wherein said first vertical axis and said first pair of vertical axes lie in a first common vertical plane and wherein said second vertical axis and said second pair of vertical axes lie in a second common vertical plane parallel to said first common vertical plane.

6. A conveyance attachable to a pier for facilitating loading and unloading the manifest items of a boat, comprising:

a landing including a first part adapted for rigid connection to said pier and including a floor and a pair of laterally spaced vertical walls at laterally opposite sides of said floor, a second part pivotally connected to said first part on a first vertical pivot axis including a pair of laterally spaced stand posts with upper ends and a first power means interconnected between said first and second parts operable to pivot said second part relative to said first part about said first vertical axis, an elongated ramp having one of its longitudinal opposite ends pivotally connected to said second part of said landing on a first horizontal pivot axis transverse to the direction of elongation of said ramp, a platform having a first segment pivotally connected to the other longitudinally opposite end of said ramp on a horizontal pivot axis parallel to said first horizontal pivot axis and including a floor and a pair of laterally spaced vertically extending rigid posts, and a second segment pivotally connected to said first segment on a second vertical axis and including a floor and a pair of laterally spaced upstanding structures, a pair of laterally spaced parallel rails having first corresponding ends pivotally connected, respectively, to the upper ends of said stand posts on a third horizontal axis and having second corresponding ends pivotally connected, respectively, to the upper ends of said rigid posts on a fourth horizontal axis, said first, second, third and fourth horizontal axes defining corners of a parallelogram, a first pair of laterally spaced upright spars pivotally supported at their upper and lower ends by said laterally spaced vertical walls on third and fourth vertical axis a second pair of laterally spaced upright spars pivotally supported at their upper and lower ends by said laterally spaced upstanding structures on fifth and sixth vertical axes a lift linkage including a pair of laterally spaced parallel upper links having first correspondence ends pivotally connected, respectively, to said upper ends of said first pair of upright spars on fifth and sixth horizontal axes and having second corresponding ends pivotally connected to said upper ends of said second pair of upright spars on a seventh and eight horizontal axes, a pair of laterally spaced parallel lower links having first corresponding ends pivotally connected respectively, to said lower ends of said first pair of upright spars on ninth and tenth horizontal axes and having second corresponding ends pivotally connected, respectively, to said lower ends of said second pair of upright spars on eleventh and twelfth horizontal axes, and second power means operatively associated with said lift linkage operable to raise and lower said platform to and from a boat disposed adjacent said pier, said upper and lower links maintaining said platform in the same orientation relative to said boat regardless of the pivot position of said second part of said landing relative to said first part of said landing.

7. The conveyance of claim 6 wherein said ramp is a stairway with self-leveling steps.

8. The conveyance of claim 7 wherein said pair of laterally spaced parallel upper rails are handrails.

9. The conveyance of 6 wherein said second power means includes a first linear fluid actuator interconnected between one of said lower links and one of said first pair of spars at one lateral side of said ramp and a second linear fluid actuator interconnected between the other of said lower links and other of said first pair of spars.

10. The conveyance of claim 6 wherein said links are spaced laterally outward from said ramp.

11. The conveyance of claim 10 wherein each of said links includes braces on their laterally outer sides.

12. The conveyance of claim 6 wherein said first vertical axis and said third and fourth vertical axes lie in a first common vertical plane and wherein said second vertical axis and said fifth and sixth vertical axes lie in a second common vertical plane parallel to said first common vertical plane.

* * * * *